United States Patent [19]

Beuchat

[11] 4,068,592

[45] Jan. 17, 1978

[54] ELECTRONIC FIRING DEVICE FOR PROJECTILES

[75] Inventor: Roger Beuchat, Geneva, Switzerland

[73] Assignee: Mefina S.A., Fribourg, Switzerland

[21] Appl. No.: 589,543

[22] Filed: June 23, 1975

[30] Foreign Application Priority Data

| | | |
|---|---|---|
| July 5, 1974 | Switzerland | 9247/74 |
| June 2, 1975 | Switzerland | 7070/75 |

[51] Int. Cl.[2] ..... F42B 9/08

[52] U.S. Cl. ..... 102/70.2 R

[58] Field of Search ..... 102/70.2 R, 70.2 G; 317/80

[56] References Cited

U.S. PATENT DOCUMENTS

| | | | |
|---|---|---|---|
| 3,073,966 | 1/1963 | Chrzanowski et al. | 102/70.2 R |
| 3,111,594 | 11/1963 | Stolte | 102/70.2 R |
| 3,417,306 | 12/1968 | Knak | 317/80 |
| 3,439,616 | 4/1969 | Godsey et al. | 102/70.2 R |
| 3,571,609 | 3/1971 | Knudson | 102/70.2 R |
| 3,575,114 | 4/1971 | Quist et al. | 102/70.2 R |
| 3,598,055 | 8/1971 | Gunderson | 102/70.2 R |
| 3,604,356 | 9/1971 | Browning | 102/70.2 R |
| 3,657,571 | 4/1972 | Martin et al. | 102/70.2 R |
| 3,814,017 | 6/1974 | Backstein et al. | 102/70.2 A |

*Primary Examiner*—Samuel W. Engle
*Assistant Examiner*—S. A. Cangialosi
*Attorney, Agent, or Firm*—Emory L. Groff, Jr.

[57] ABSTRACT

An electronic firing device for a pyrotechnic charge in a projectile comprises a programmable unijunction transistor controlled by the discharge of a firing capacitor to fire an electric fuse. An oscillator supplies a pulsed output signal via a charging circuit to intermittently charge the capacitor in steps. The oscillator output signal is also supplied as a clock signal to a delay device controlling conduction of the transistor to fire the fuse after a given delay following an impact.

5 Claims, 1 Drawing Figure

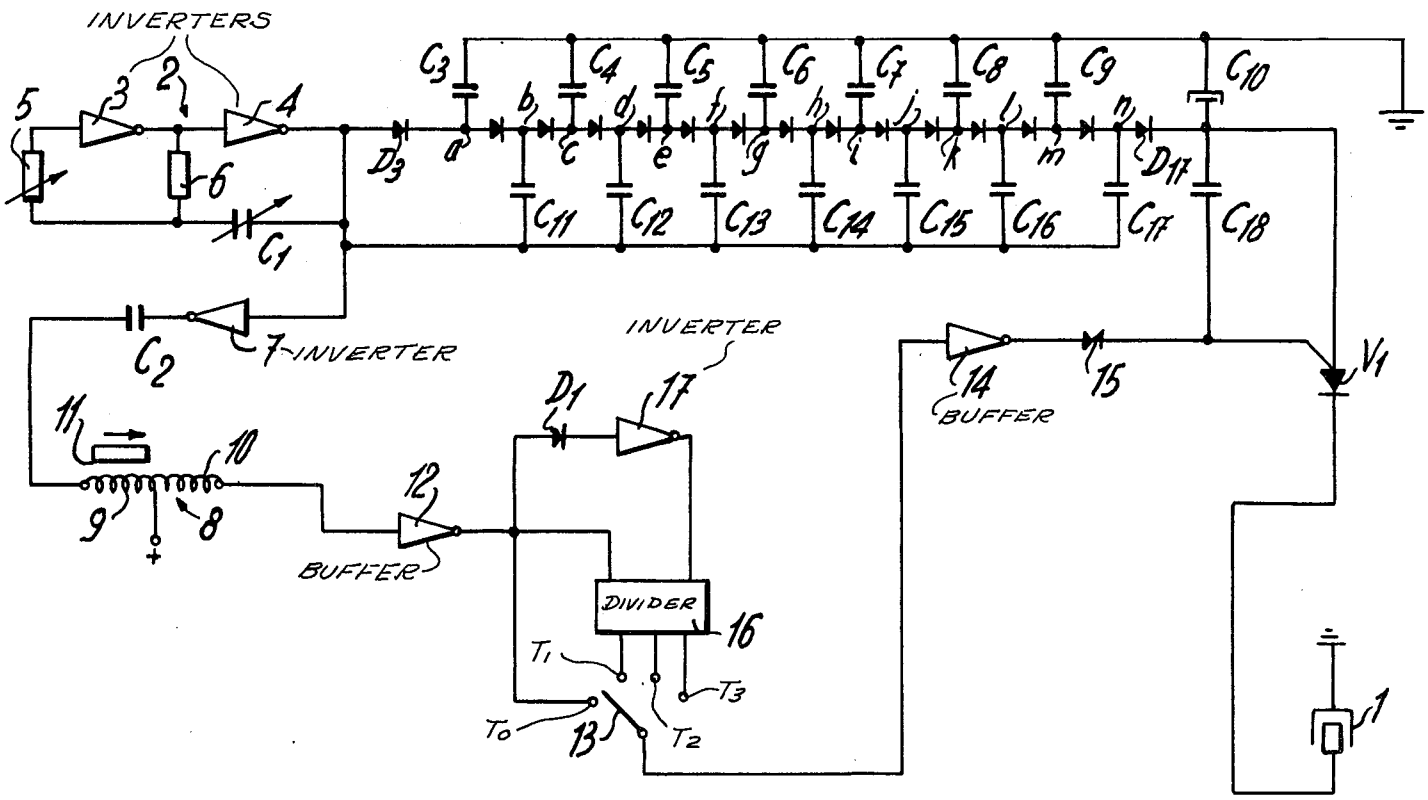
INVERTERS
INVERTER
INVERTER
BUFFER
BUFFER
DIVIDER

ELECTRONIC FIRING DEVICE FOR PROJECTILES

The invention relates to electronic firing devices for pyrotechnic charges, in particular for projectiles, and more particularly concerns such a device comprising a firing capacitor whose charge is applied to an electric fuse via a controlled-conductivity semiconductor element.

An aim of the invention is to provide such a device having a low current consumption, a small volume, a time delay for firing of the fuse, i.e. a bore or hood safety, and a great facility for regulation of this time delay.

According to the invention, a firing device of the stated type comprises an oscillator providing a pulsed output signal to means for charging the capacitor and applied as clock signal to a device for delaying firing of the fuse.

The single FIGURE of the accompanying drawing shows, by way of example, the circuit diagram of an embodiment of the device according to the invention, which can be provided with complementary MOSFET circuitry.

The device shown comprises an electric fuse 1 firing of which is produced by the discharge of a firing capacitor $C_{10}$, this discharge being controlled by a programmable unijunction transistor $V_1$. This transistor may become conducting as soon as a signal is applied to its control electrode and a voltage applied between its anode and cathode reaches a first value or, in the absence of a signal on its control electrode, as soon as said voltage reaches a second value.

The firing capacitor $C_{10}$ is supplied from an oscillator 2 formed by two inverters (negators) 3 and 4 connected as shown to resistors 5 and 6 and a capacitor $C_1$. Oscillator 2 supplies an output signal consisting of rectangular pulses having an amplitude of about 3 V.

These pulses are applied to the input of a circuit for charging capacitor $C_{10}$. This circuit is composed of a cascade of diodes $D_3$ to $D_{17}$ in series, the points connection *a, b . . . m, n* between these diodes being connected alternately by capacitors $C_3$ to $C_9$ to ground, i.e. to one of the output terminals of the oscillator, and by capacitors $C_{11}$ to $C_{17}$ to the other terminal of the oscillator, i.e. to the input of diode $D_3$. This charging circuit operates as follows:

All of the capacitors $C_{11}$ to $C_{17}$ receive output pulses of oscillator 2 by their lower terminal. Each time their lower terminal is positive, these capacitors transmit, by the next following diode, a charge to each of the capacitors $C_3$ to $C_9$. During the interval between two pulses, the lower terminal of the capacitors $C_{11}$ to $C_{17}$ comes back to ground potential and, during this time, the charge of each of the series of capacitors $C_3$ to $C_9$ is partly transmitted by the next following diode, to the following one of the series of capacitors $C_{11}$ to $C_{17}$, so long as the voltage of each of the first series of capacitors is greater than the threshold voltage of the following diode. This threshold voltage is about 0.6 V.

In this manner, the charge of each capacitor increases by intermittence in synchronization with the pulses of oscillator 2, and this increases propagates from the left to the right of the circuit. The voltage of the firing capacitor $C_{10}$ thus increases stepwise, so that the required voltage for operation of transistor $V_1$ is reached after a given number of pulses of the oscillator 2, which enables definition of a time constant for charging capacitor $C_{10}$.

The maximum voltage that can be applied to capacitor $C_{10}$ is determined by the number of diodes and their threshold voltage. Moreover, the increase of voltage from one capacitor to the next is limited by the threshold voltage of the diode separating them, since as soon as this voltage is reached, a charging current can no longer flow through this diode from one capacitor to the next. The provided value of said maximum voltage is relatively high to produce self-ignition of transistor $V_1$, which enables self destruction of the projectile, for example in the event that the firing pin (of a projectile incorporating the electronic firing device) fails to operate.

The oscillator pulses are also applied to a tripping device 8 via an inverter (negator) 7, which acts as buffer to reshape the pulses, and a capacitor $C_2$.

Tripping device 8 is formed by an electromagnetic transducer comprising two windings 9 and 10 in series, able to be coupled by a ferromagnetic core 11 movable by a percussion-sensitive member of a projectile incorporating the firing device.

After displacement of core 11, the pulses applied to winding 9 induce pulses in winding 10, these pulses being amplified by a buffer 12, simultaneously providing a shaping to provide rectangular pulses. If it is desired to produce firing upon impact without a delay, the output of buffer 12 is connected by terminal $T_0$ of a contactor 13 to the control electrode of transistor $V_1$ via a buffer 14 and a Zener diode 5.

To produce firing with a delay after percussion, the device comprises a frequency divider 16 connected to the output of buffer 12. The signal of buffer 12 is applied directly to one input of divider 16 and via a diode $D_1$ and an inverter (negator) 17 to its other input. The purpose of the latter input is to zero-set divider 16 when buffer 12 gives no output signal. The divider 16 has three output terminals $T_1$, $T_2$ and $T_3$ corresponding to successive dividers, and contactor 13 enables selection of these outputs to give the desired delay.

In the described device, it is easy, by means of the variable resistor 5 and/or variable capacitor $C_1$, to provide a regulation of the frequency of the pulses of oscillator 2. This regulation enables the time required for charging capacitor $C_{10}$ to be set to a desired value, with a simultaneous setting of the delay time for firing given by divider 16.

An advantage of the described device is that its operation is not in principle modified by the value of the supply voltage. The latter may be chosen in a range from the order of one volt to several tens of volts.

Of course, various modifications of the abovedescribed device may be provided; by way of example, it would in particular be possible to use a divider 16 having a greater number of outputs and consequently enabling extra time-delay settings. The pulses could be delivered to divider 16 by a simple switch arranged to be closed upon impact.

Instead of being rectangular, the output signal of oscillator 2 could be formed by pulses of any shape, notably saw-tooth pulses. In the latter case, a trigger could be provided between oscillator 2 and the counter or frequency divider 16 to provide a rectangular signal at the input of the latter.

Also, the frequency divider could be replaced by other electric, electronic or even mechanical time-delay devices.

I claim:

1. An electronic firing device for a pyrotechnic charge, comprising an electric fuse, a firing capacitor, a delay device, a controlled-conductivity semi-conductor element for delivering the charge of said capacitor to said fuse, an oscillator providing a pulsed output signal which is simultaneously applied, on the one hand, to means for charging said capacitor, and on the other hand, to the delay device as a clock signal, said delay device controlling said controlled-conductivity semi-conductor element.

2. A device as claimed in claim 1, comprising a firing circuit adapted to charge the firing capacitor in steps and having a time constant selected to provide a given time delay until the charge of the capacitor is sufficient to allow firing of the fuse.

3. A device as claimed in claim 1, in which said delay device comprises a frequency divider delivering a firing pulse after a time proportional to the frequency of the clock signal divided by the number of levels of the divider.

4. A device as claimed in claim 3, comprising a Zener diode for calibrating the output pulse of said divider which is applied to the semi-conductor element to control conduction thereof.

5. A device as claimed in claim 1, in which the semi-conductor element is a programmable transistor programmed to define the voltage of said firing capacitor above which the transistor automatically conducts to fire the fuse to produce self-destruction of the pyrotechnic charge.

* * * * *